US009737776B1

(12) United States Patent
Venigalla

(10) Patent No.: US 9,737,776 B1
(45) Date of Patent: Aug. 22, 2017

(54) RANDOM LAUNCHING AND ADJUSTABLE APERTURE CATCHING GAME

(71) Applicant: Verily Products Group LLC, Glen Head, NY (US)

(72) Inventor: Rajendraprasad Venigalla, Glen Head, NY (US)

( * ) Notice: Subject to any disclaimer, the term of this patent is extended or adjusted under 35 U.S.C. 154(b) by 0 days.

(21) Appl. No.: 15/280,520

(22) Filed: Sep. 29, 2016

Related U.S. Application Data

(60) Provisional application No. 62/234,077, filed on Sep. 29, 2015.

(51) Int. Cl.

| | |
|---|---|
| ***A63B 65/12*** | (2006.01) |
| ***A63B 67/00*** | (2006.01) |
| ***A63B 43/00*** | (2006.01) |
| ***A63F 9/24*** | (2006.01) |
| *A63F 9/02* | (2006.01) |

(52) U.S. Cl.
CPC ..... *A63B 67/002* (2013.01); *A63B 43/00* (2013.01); *A63B 65/122* (2013.01); *A63F 9/24* (2013.01); *A63F 9/0204* (2013.01)

(58) Field of Classification Search
CPC ..... A63B 65/122; A63F 9/02
USPC ..... 273/355, 371–377; 473/511
See application file for complete search history.

(56) References Cited

U.S. PATENT DOCUMENTS 930,918 A * 8/1909 Barry ..... A63B 67/083 473/509
1,034,716 A * 8/1912 Kruger ..... A63B 65/125 473/511
1,091,739 A * 3/1914 Falker ..... A63B 65/125 273/119 R
1,767,232 A * 6/1930 Uhlig ..... A63B 65/122 124/37
2,097,106 A * 10/1937 Stewart ..... A63B 65/122 473/511
2,617,651 A * 11/1952 Gerhold ..... A63B 65/122 124/16
2,636,738 A * 4/1953 Abagoff ..... F41B 7/003 124/16
2,808,264 A * 10/1957 Scalf ..... A63B 63/083 124/1
3,861,685 A * 1/1975 Trbovich ..... A63F 3/00041 124/16
4,826,176 A * 5/1989 Kobayashi ..... A63F 9/02 273/354
5,141,236 A * 8/1992 Petitto ..... A63B 65/122 473/511
5,292,134 A * 3/1994 Schlundt ..... A63B 65/122 124/65
8,096,557 B2 * 1/2012 Lin ..... A63B 24/0021 273/371
9,579,553 B2 * 2/2017 Rehkemper ..... A63F 9/0252

* cited by examiner

*Primary Examiner* — Mark Graham
(74) *Attorney, Agent, or Firm* — Chan Hubbard PLLC

(57) ABSTRACT

A catching game that is challenging even when played by one player. The catching game is a paddle-sized hand-held device that preferably incorporates an automatic launcher and an adjustable aperture catcher on the same hand-held device. The automatic launcher incorporates randomness into the launching mechanism, in order to increase the challenge to the player(s). The game also incorporates an electronic sensor to determine when a catch has been made.

4 Claims, 4 Drawing Sheets

RANDOM LAUNCHING AND ADJUSTABLE APERTURE CATCHING GAME

FIELD OF THE INVENTION

The invention lies in the field of toys and games.

BACKGROUND

Throwing and catching games have long been a popular form of exercise and entertainment. They are also an excellent method for developing hand and eye coordination. Throwing and catching games typically require more than one player if they are to be played in a challenging and entertaining manner. This is because a person playing catch alone is limited to a small radius in which they can feasibly run after throwing the ball alone, and because there is little challenge in catching a ball when you know where you have thrown it. Thus, a solo-player throw and catch game is not usually expected to be very challenging or entertaining.

SUMMARY

The claimed device seeks to provide a throw and catch game that can be entertainingly played by one person. It is a further object to provide a game that automates the throwing and scoring parts of the game, allowing one or multiple players to focus on the challenge of catching.

The Applicant herein describes a game that launches balls automatically and at unpredictable directions and speeds. The launching and catching are incorporated into a single handheld device, making it fully entertaining and challenging even when played by only one person. The claimed device also comprises a hand-held target with a variable-size aperture for catching the ball. The size of the opening can be made large or small to change the difficulty of the game. Thus, the game features two types of difficulty to entertain the single player: variation in ball-launching, and variation in catching difficulty. The game can be played by multiple players who catch balls from the other player's launching device, and another embodiment of the game comprises a standalone automatic launcher from which one or more players can catch launched balls.

The claimed device incorporates electronic scorekeeping, including electronic detection of scores and electronic display of scores. As such, the game facilitates score-tracking and competing with other players. It can also incorporate speakers and LED to add sound and visual reward factors when the player makes successful catches. Finally, the game is convenient for storage and play, by incorporating ball storage and launching in one handheld unit.

DETAILED DESCRIPTION

Figure 1:
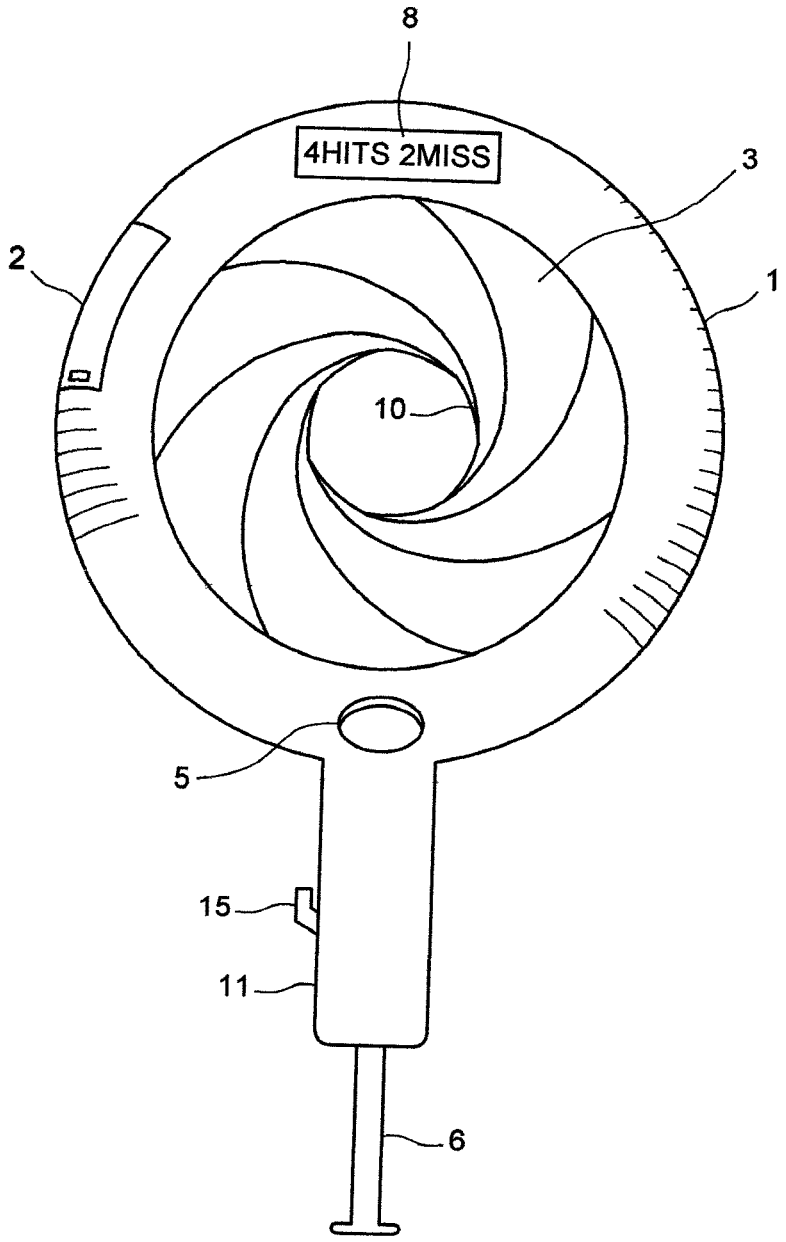
FIG. 1 is a top plan view of the handheld game.
Figure 2:
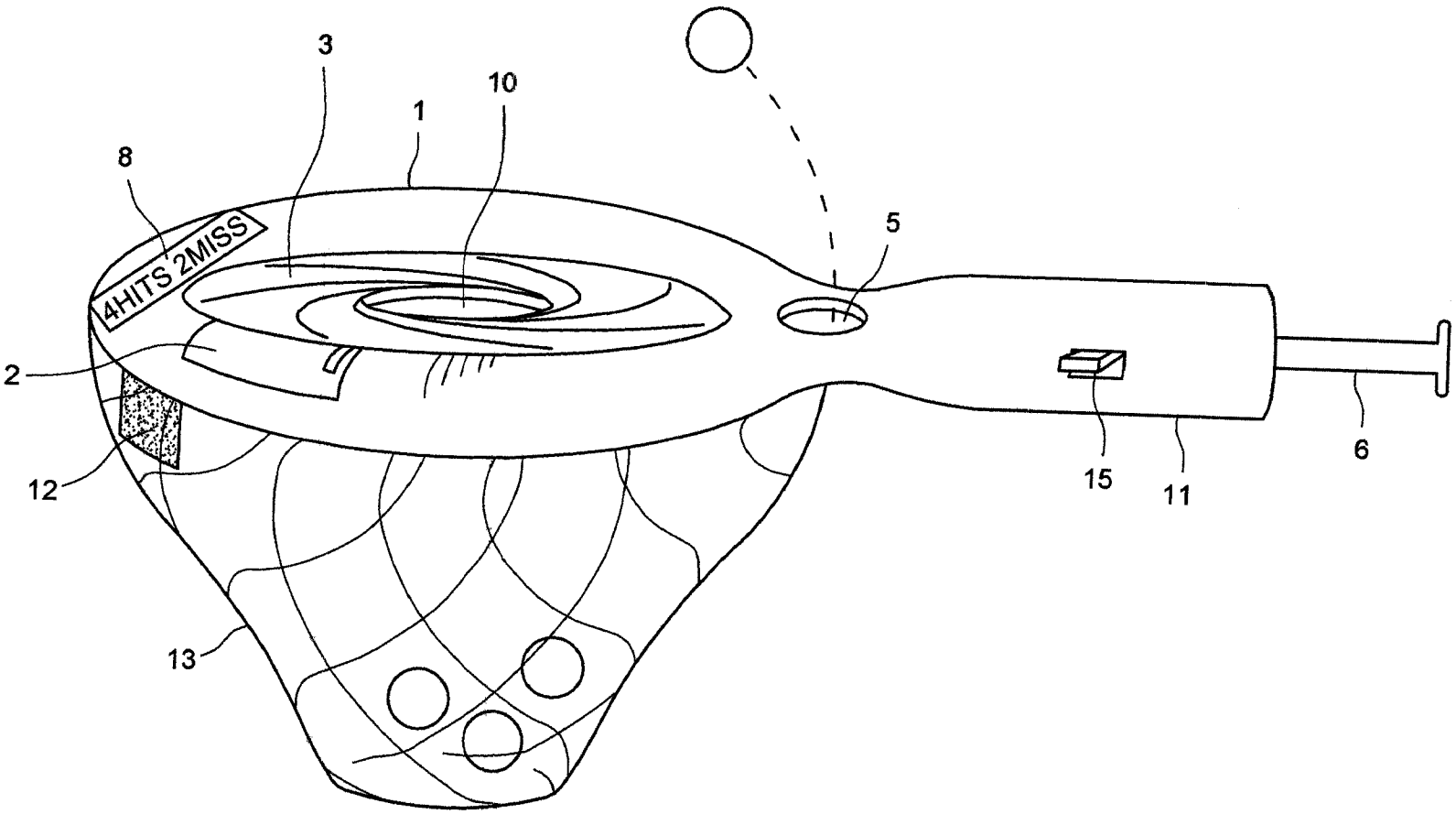
FIG. 2 is a side view of the handheld game.

This is a paddle-type catching game that is playable by a single player, easy to store, and incorporates randomness into the game play. The game is a handheld device comprising a handle 11 and a target frame 1. The frame holds an adjustable target 10, such that the goal of the game is to catch balls through the target 10. The balls are launched directly from the handheld game itself by an automatic launcher 6, and moreover the frame is hollow to facilitate storage of the balls and also to feed the balls directly to the automatic launcher. The automatic launcher, described in more detail below, incorporates randomness into the game play, such as by varying the direction of launch, the number of balls launched, and the speed of launch.

The handheld game also comprises electronic scoring and control, including, but not limited to, a sensor 12 to detect catches through the target 10 and a display 8 showing the score. Display 8 may show any additional information readily programmable by one of ordinary skill in the art given the electronic functionalities herein described, and may be located anywhere on the handheld device. Catch information can also be recorded and uploaded to a server via a Bluetooth or wireless controller, allowing the user to track their progress. The sensor 12 may include one or more sensors including infrared sensors located on the underside of the handheld apparatus in order to sense a projectile passing through the target area, piezoelectric sensors for detecting additional weight within a net 13, and may also include touch sensors and motion sensors such as gyroscopes. The handheld device may also comprise readily programmable elements such as LEDs and/or speakers to light up and/or make noises on player "misses," such as the ball hitting the frame and missing the target. These electronic additions can also be used to show and/or play rewarding visuals and/or music when the balls are successfully caught. LEDs can also be used to decorate the frame, or the frame may have glow-in-the-dark elements.

The frame 1 may be circular, as depicted, to exemplify a paddle-type game, but may be any shape of frame. The frame encircles or holds a target 10 whose aperture diameter is adjustable, thus changing the difficulty of the game. The target may comprise a plate that is insertable into the frame, the plate comprising one or more openings of different shapes and/or diameters. Multiple interchangeable, insertable targets allow customization for different levels of difficulty and entertainment. The target may also comprise an adjustable diameter aperture constructed as a mechanical iris. For instance, as in typical mechanical irises, the target may comprise a set of blades 19 that are pivotable and anchored to the frame, and an actuating ring disposed within the frame that causes the blades to rotate and thereby open and close the target aperture 10.

Figure 3:
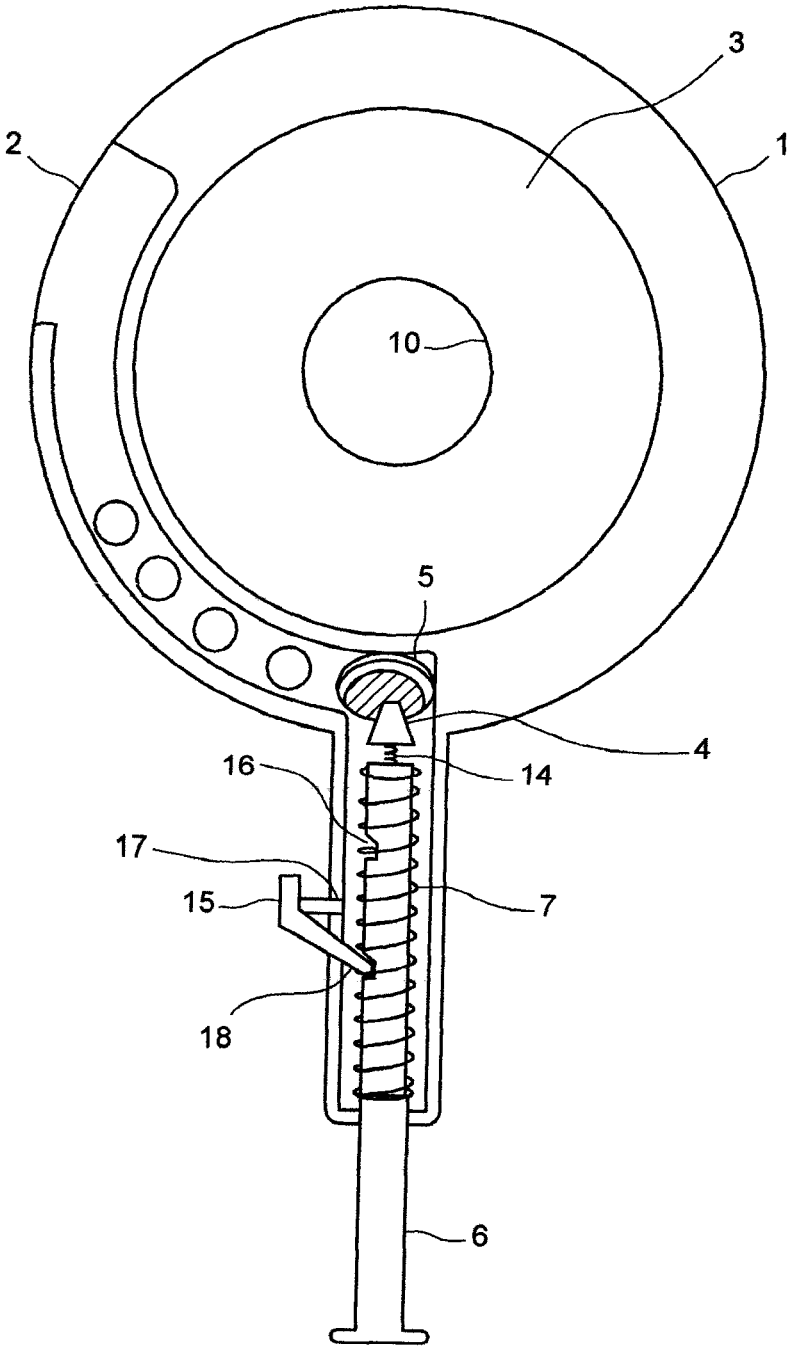
FIG. 3 is a top plan view of a horizontal cross-section of the handheld game.

The frame is hollow to facilitate the storage of balls, which can be inserted directly into the frame via window 2. Furthermore, this storage lane facilitates the feeding of balls directly to the automatic launcher via launching area 5, as illustrated in FIG. 3. Balls fall into launching area 5 whenever it is empty, such as when the automatic launcher is loaded. Launching area 5 may be located anywhere on the device but is optimally located where handle 11 meets frame 1, particularly when automatic launcher 6 is incorporated into the handle. The automatic launcher may be spring-loaded, as described below, but may rely on other types of force, including, but not limited to, mechanical, pneumatic or hydraulic. The game does not require specially constructed projectiles and can be used with existing balls such as ping pong balls.

As illustrated in FIG. 3, a cross-sectional view from the top of the handheld game, the automatic launcher 6 may be implemented with a spring driven plunger 7. Catch areas such as notch 16 allow for the plunger to be loaded and held in place by trigger release 18, which is released when trigger 15 is activated. Multiple catch areas may be built into the plunger to allow the automatic launcher to be activated at differing amounts of force. In another embodiment, the automatic launcher releases one ball first, then another ball moments later, increasing the challenge and unpredictability of the game.

Additional variation and randomness may be incorporated into the automatic launcher. In the mechanical version depicted in FIG. 3, a wedge-shaped head 4 is coupled to spring 14 causing the wedge to bobble or rotate. When automatic launcher is activated, the bobbling wedge causes the ball to be launched in unpredictable directions. The wedge design of the head furthermore causes the ball to be launched at unpredictable angles. In another embodiment, the game is also supplied with balls of different weights and sizes, resulting in variable launch speeds.

Figure 4:
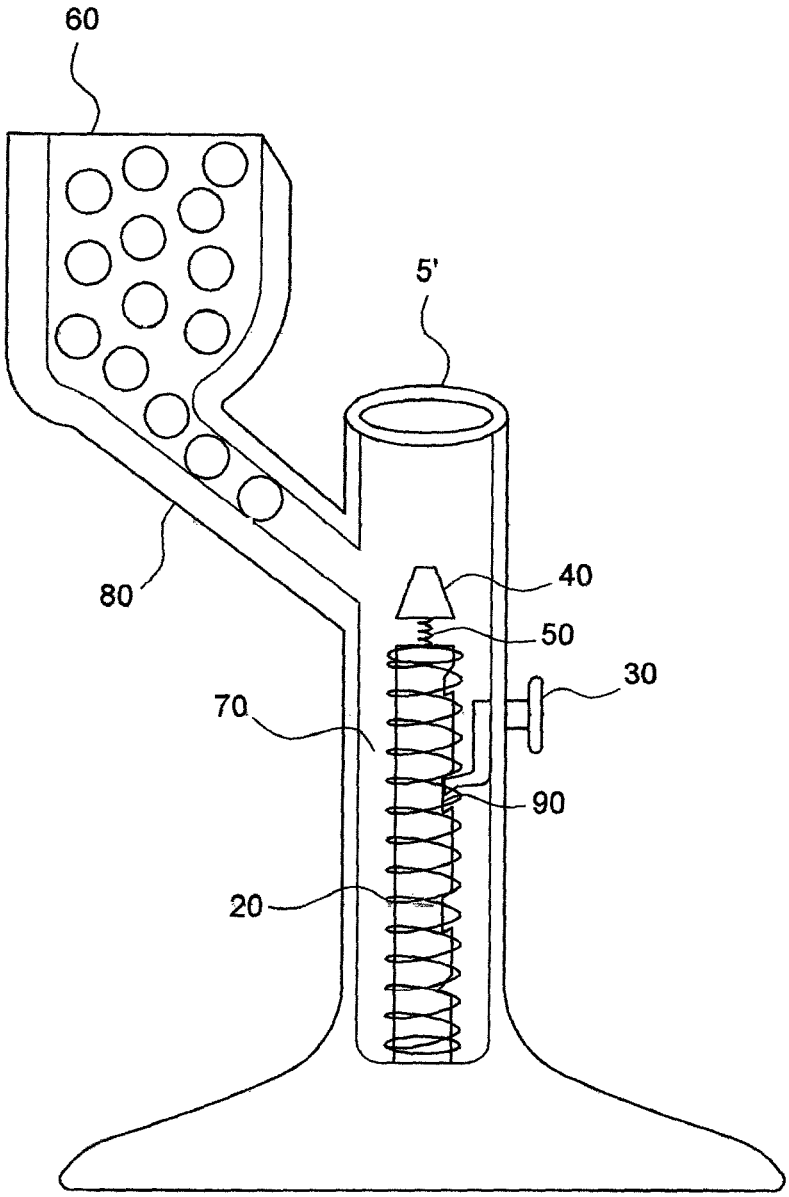
FIG. 4 is front view of a cross-section of a standalone ball launcher.

In another embodiment, depicted in FIG. 4, the automatic launcher may be separate from the hand-held catcher. Ball storage unit 60 can be used to store balls and cause them to automatically fall into position when automatic launcher 70 is loaded. As noted previously, the automatic launcher may be spring-loaded, as described below, but may rely on other types of force, including, but not limited to, mechanical, pneumatic or hydraulic. As previously described, the automatic launcher 70 may be implemented with a spring driven plunger 20. Catch areas such as notch 90 allow for the plunger to be loaded and held in place by trigger 30, such that the plunger launches the ball into the air when the trigger is activated. Multiple catch areas may be built into the plunger to allow the automatic launcher to be activated at differing amounts of force. Additional variation and randomness may be incorporated using a wedge-shaped head 4 coupled to spring 14 causing the wedge to bobble or rotate. When automatic launcher is activated, the bobbling wedge causes the ball to be launched in unpredictable angles and directions. The standalone embodiment enables a multi-player version of the game in which players, each using a personal hand-held catcher, compete to catch randomly launched balls.

What is claimed is:

1. A handheld game comprising:

a target frame encircling a target of adjustable difficulty, wherein the target comprises a mechanical iris, and wherein the target frame is hollow and capable of storing balls;

an automatic launcher operable to receive balls from the target frame and to launch balls, wherein the automatic launcher comprises a wedge-shaped head coupled to a spring that is coupled to a spring-loaded plunger such that the wedge-shaped head is capable of launching balls in randomized directions;

a motion sensor capable of detecting movement of a ball through the target; and an electronic score display.

2. The handheld game of claim 1 further comprising a set of balls of different weights.

3. A game comprising:

an automatic launcher having a ball storage unit, wherein the automatic launcher comprises a wedge-shaped head coupled to a spring and coupled to a spring-loaded plunger such that the wedge-shaped head is capable of launching balls in randomized direction;

a handheld catcher comprising a target frame encircling a target of adjustable difficulty, wherein the target comprises a mechanical iris;

a motion sensor capable of detecting movement of a ball through the target; and an electronic score display.

4. The game of claim 3 further comprising a set of balls of different weights.

* * * * *